United States Patent [19]

Webb, Jr.

[11] 4,077,353

[45] Mar. 7, 1978

[54] MOTOR MOUNT FOR A BOAT

[76] Inventor: Lewis W. Webb, Jr., 5232 Edgewater Dr., Norfolk, Va. 23508

[21] Appl. No.: 755,505

[22] Filed: Dec. 29, 1976

[51] Int. Cl.[2] ..... B63H 5/12

[52] U.S. Cl. ..... 115/41 R; 115/17; 248/4

[58] Field of Search ..... 115/17, 18 R, 41 R, 115/12 A; 248/4, 16, 291, 14; 403/335, 336, 328, 378, 379

[56] References Cited

U.S. PATENT DOCUMENTS

| | | | |
|---|---|---|---|
| 1,930,181 | 10/1933 | Peters | 248/14 X |
| 2,390,135 | 12/1945 | Tobias | 248/4 |
| 2,463,124 | 3/1949 | Sims | 403/379 X |

*Primary Examiner*—Stephen G. Kunin
*Assistant Examiner*—Sherman D. Basinger
*Attorney, Agent, or Firm*—Stevens, Davis, Miller & Mosher

[57] ABSTRACT

A device is provided for mounting an outboard motor on the transom of a boat which can be rotated about a horizontal axis to lift the motor out of the water. One embodiment of the device includes two sleeves with an inner sleeve rotatably disposed in an outer sleeve and an outer sleeve is secured at one end to a plate member adapted to be clamped by the conventional inverted U-shaped clamp provided with commercial outboard motors. A second embodiment employs only one sleeve having an annular flange on one end and a plate assembly on its opposite end. The device is mounted on the transom or in a well with its center line of rotation in a horizontal or near horizontal plane. The outboard motor is attached to the device with the center of gravity of the motor on or near the center line of rotation to facilitate rotation of the motor to a lift position out of the water.

3 Claims, 8 Drawing Figures

FIG. 1
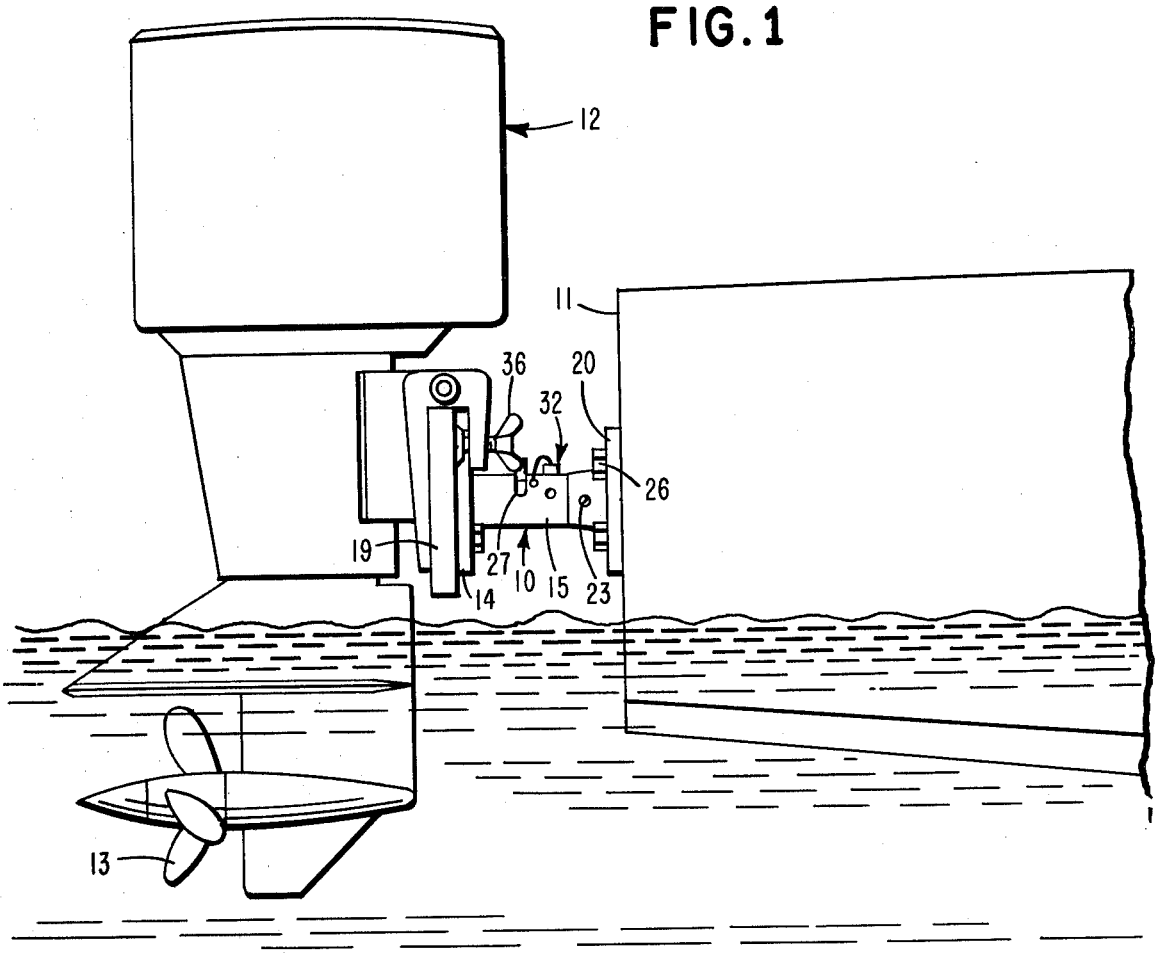
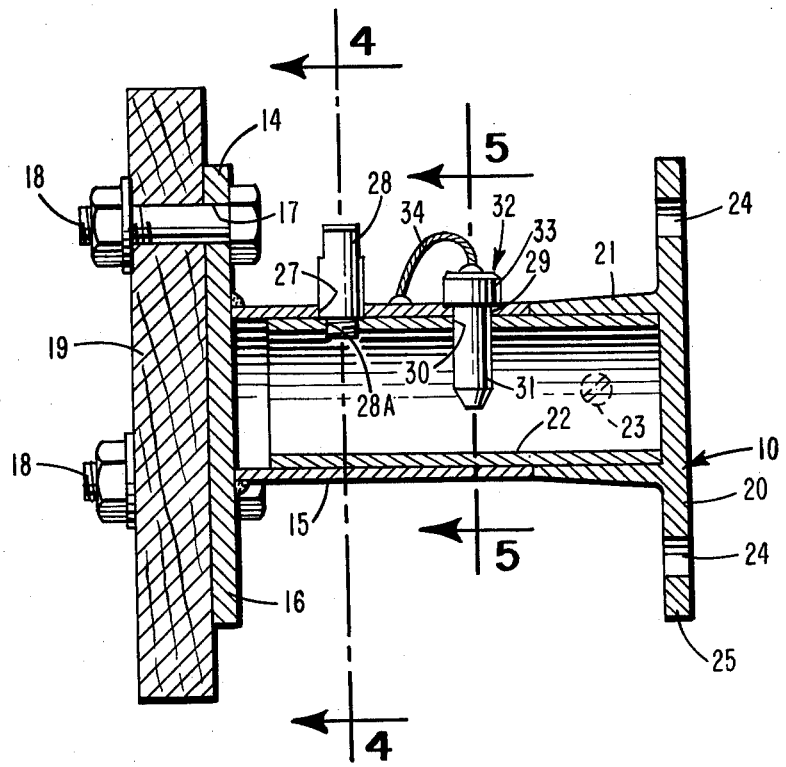
FIG. 3

FIG. 2
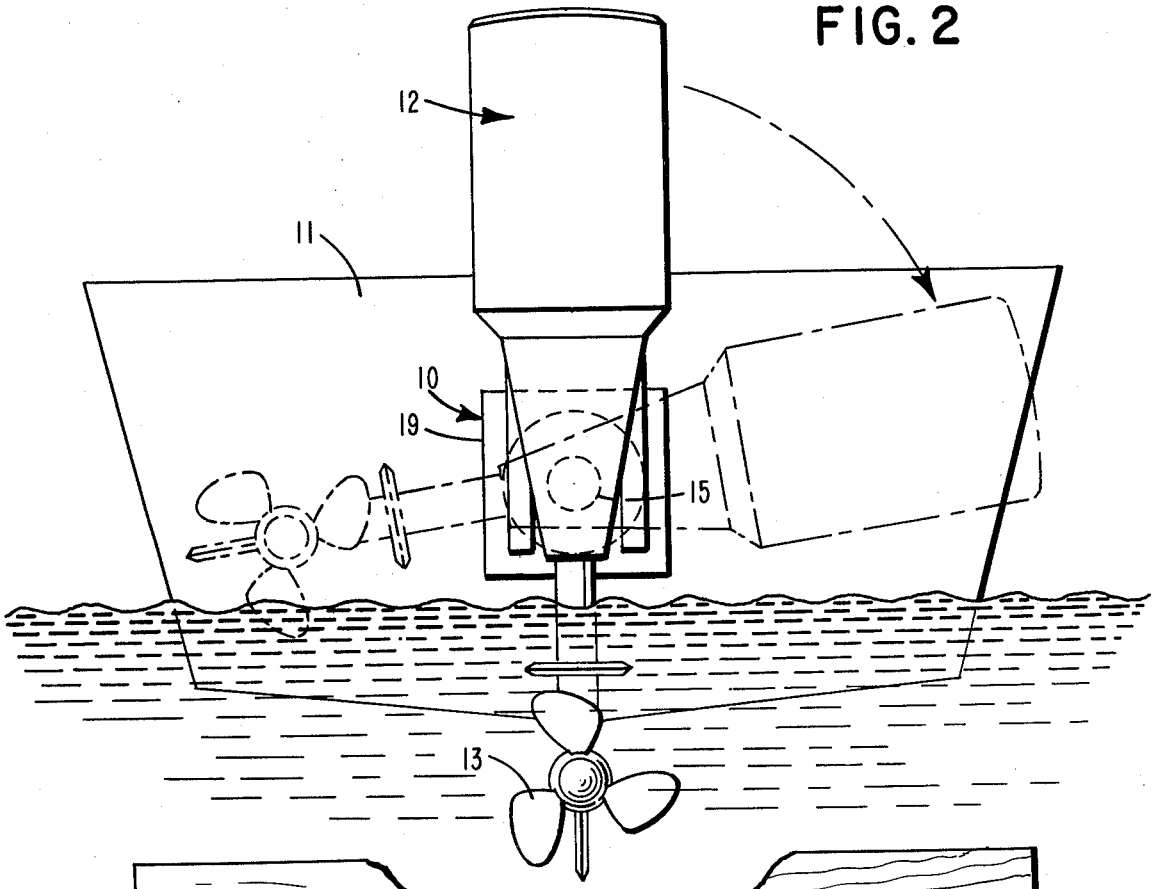
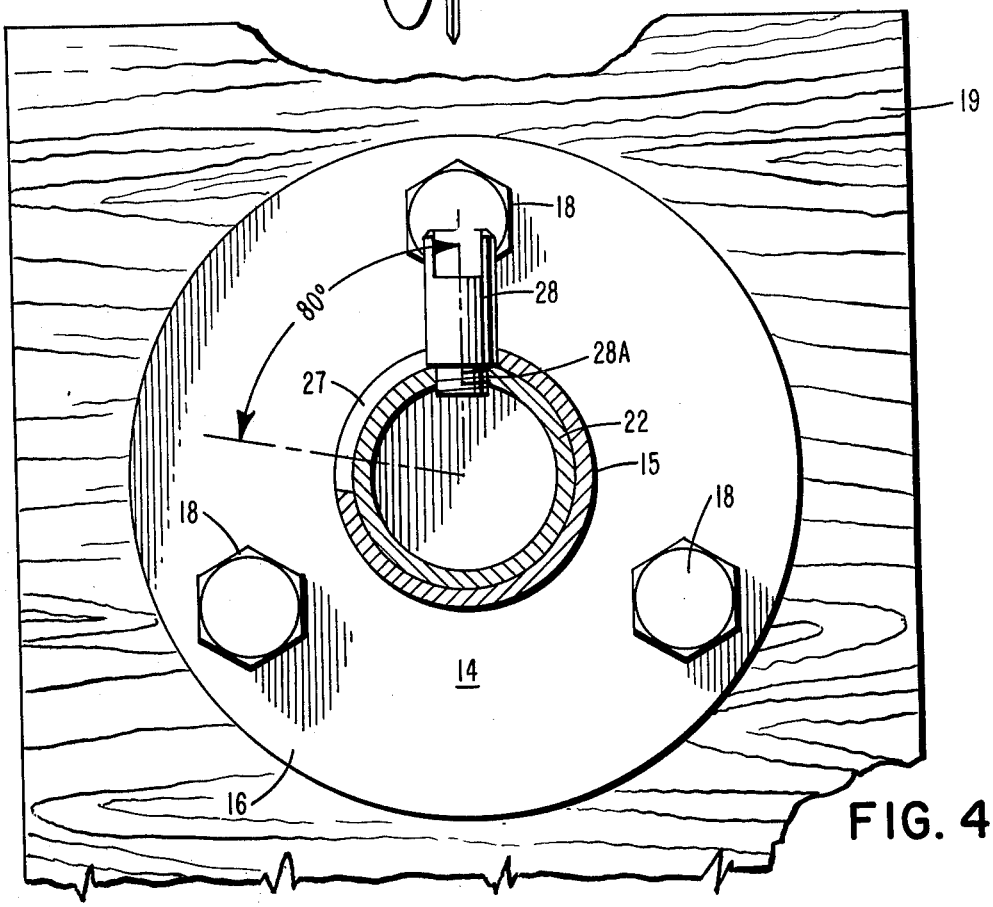
FIG. 4

MOTOR MOUNT FOR A BOAT

This invention relates generally to outboard motors for boats and more particularly to an improved device for mounting an outboard motor on the transom or in a well of a boat.

The commercially available outboard motors for boats are provided with a clamp for pivotally attaching the motor to the boat transom or well. The clamp has an inverted U-shaped member adapted to fit rather snugly over the top edge of the transom or well and a screw for securing the U-shaped member to the boat. The motor may have one or more of the clamps and/or screws depending upon the weight of the motor. The U-shaped clamp is made in two parts pivotally mounted on a pin which has its longitudinal axis in a plane parallel to the transverse axis of the boat. The pin on which the motor pivots is located in the closed end of the clamp and the motor is pivoted for lifting out of the water by swinging it above the pivot point with the top of the motor moving downwardly and towards the transom and the propeller moving outwardly with respect to the boat and upwardly out of the water. The problem with such a means for removing the motor from the water is that considerable pressure is required to pivot the motor into a position out of the water particularly if the motor is of large horsepower and heavy. Consequently, there is a tendency to leave the motor in its vertical operable position with the propeller and drive shaft in the water when the boat is not in use.

It is an object of this invention to provide a device for mounting a motor on a boat transom or well which permits removal of the motor from the water with a minimum amount of effort. Another object of the invention is to provide a mounting device for securing an outboard motor to the transom or well of a boat which can be used to quickly and easily pivot the motor without detaching it from the transom or well into a position where it is substantially entirely above the water.

Other objects will become apparent from the following description with reference to the drawing wherein FIG. 1 is a side elevation of one embodiment of the invention supporting an outboard motor on a boat;

FIG. 2 is an elevation of the embodiment of FIG. 1 looking towards the rear of the boat;

FIG. 3 is a longitudinal section of the embodiment of the invention shown in FIG. 1;

FIG. 4 is a cross-section taken along the line 4-4 of FIG. 3;

Figure 6:
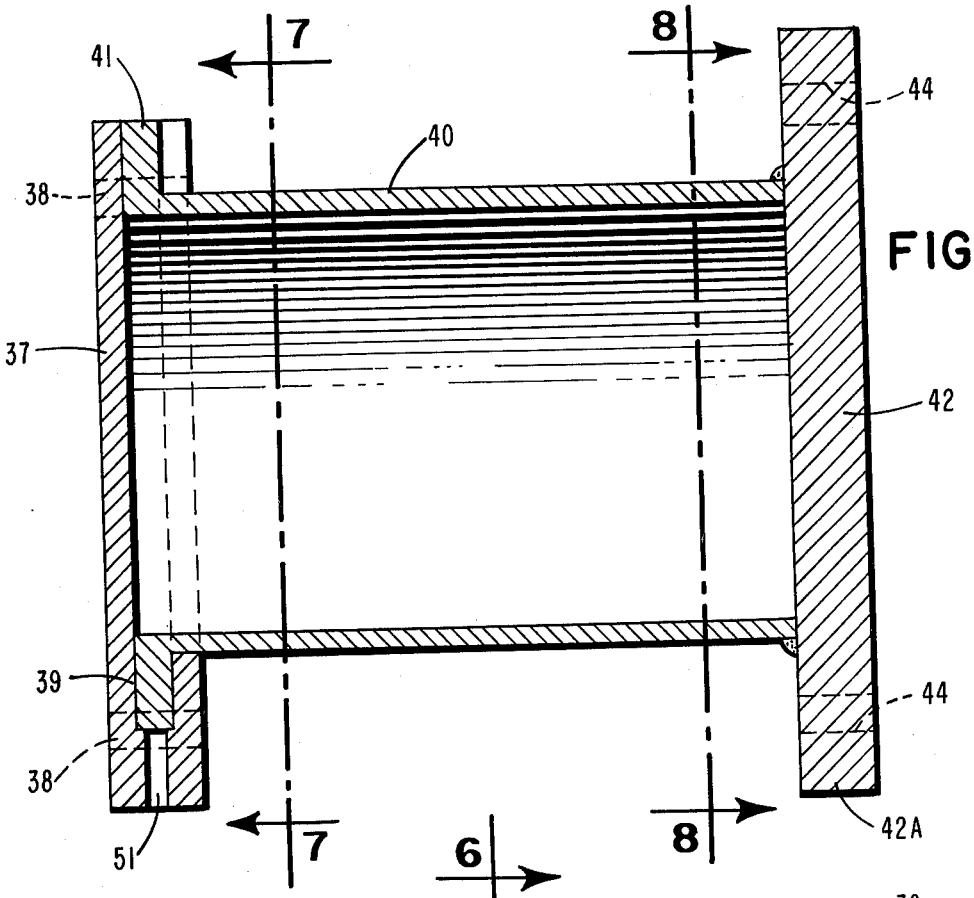
FIG. 6 is a longitudinal section of a second embodiment of the invention taken along the line 6-6 of FIG. 7.

The foregoing objects and others are accomplished in accordance with this invention, generally speaking, by providing a device having a sleeve assembly which rotates about a horizontal axis which is perpendicular to the transverse axis of the boat and which is provided with a means for securing the assembly at one end to the transom of a boat and a means on the other end for supporting an outboard motor for rotation with the sleeve, the sleeve assembly having a means for controlling the degree of rotation of the sleeve and for locking the sleeve against rotation when the motor is supported in its operable position on the boat transom.

Referring now to the drawing, one embodiment of the invention is illustrated in FIGS. 1–5. The novel motor mount 10 is shown in FIG. 1 attached at one end to the transom 11 of a boat and attached at the other end to an outboard motor 12 with the center line of rotation of mount 10 in a substantially horizontal plane. Outboard motor 12 is attached to mount 10 with the center of gravity of the motor on or near the center line of rotation of mount 10. The mount 10 is fastened to transom 11 at a point where the propeller 13 of motor 12 is at the proper depth under water for optimum performance of the outboard motor 12.

As illustrated in FIG. 3, motor mount 10 has a circular plate member 14 welded on one face to the end of a sleeve 15. Sleeve 15 has a cross-section which is smaller than the diameter of plate 14 so an annular portion 16 is provided about sleeve 15. A series of circumferentially spaced holes 17 are provided in portion 16 of plate 14 and bolts 18 secure the assembly of plate 14 and sleeve 15 to a wood block 19 against relative movement.

A second plate member 20 has a sleeve 21 welded to one face thereof. The external diameters of sleeves 15 and 21 may be substantially equal so the ends thereof abut as shown in FIG. 3 when the plate and sleeve assemblies are associated together. A third sleeve 22 is inserted in sleeve 21 and welded or secured to sleeve 21 with set screws 23 so sleeves 21 and 22 rotate together inside sleeve 15. Plate 20 is larger in cross-section than sleeve 21 and has a series of circumferentially spaced holes 24 in the annular portion 25 for receiving bolts 26 (FIG. 1) to secure the motor mount 10 to the transom 11 of a boat.

The outside diameter of sleeve 22 is only slightly smaller than the inside diameter of sleeve 15. Sleeve 22 is rotatably disposed in sleeve 15 as shown in FIG. 2. A grease fitting 50 is provided for lubrication of the bearing surfaces of sleeve 15 and 22. A guide slot 27 in the wall of sleeve 15 receives a pin 28 threadably secured in a hole 28A in sleeve 22. Slot 27 extends only partially around the periphery of sleeve 15 to limit rotation of sleeve 22 in sleeve 15. As indicated in FIG. 4, slot 27 extends from a point which permits pin 28 to be perpendicular to the transverse axis of sleeve 15 to a point on the transverse axis of sleeve 15. This limits rotation of sleeve 22 to an arc of not more than 90°. Preferably rotation of sleeve 15 is limited to about 80° so the motor when moved to its lift position is disposed as shown in dotted lines in FIG. 2 with the motor above the water level.

A hole 29 is provided in the top of sleeve 15 spaced longitudinally from slot 27 and centered approximately on the vertical axis of sleeve 15. A matching hole 30 is provided in sleeve 22 on the top of sleeve 22 centered on its vertical axis at a point where the hole 29 overlies hole 30 when sleeves 15 and 22 are positioned as shown in FIG. 4 with motor 12 disposed substantially perpendicular to the boat bottom and in the water as illustrated in FIGS. 1 and 2. The shaft 31 of a pin 32 is dropped into the matching holes 29 and 30 with enlarged head 33 resting on the surface of flange 15 to hold the sleeves 15 and 22 in the position where motor 12 is in its operable position in the water. A flexible cable 34 may be secured at one end to sleeve 15 and at the other end to pin 32 to avoid loss of the pin 32 when it is not in use.

A second hole 35 may be drilled in sleeve 22 about 80° from hole 30 at a point where it underlies hole 29 in sleeve 15 when sleeve 15 is rotated to lift motor 12 out of the water in a position similar to that shown with dotted lines in FIG. 2. Pin 32 is inserted in the holes as described above.

In operation of the embodiment of the invention illustrated in FIGS. 1–5, the assembled motor mount 10 is secured to transom 11 by means of bolts 26. Motor 12 is then secured by the coventional clamps 36 provided with outboard motors and wood block 19 as shown in FIG. 1. Preferably sleeves 15 and 22 are locked together with pin 32 in the position where the block 19 is perpendicular to the transverse axis of the sleeves as shown in FIG. 2 and motor 12 is in its operable position. If the motor is not to be used immediately, it is lifted from the water by rotating sleeve 15 on sleeve 22 until hole 35 is disposed directly below hole 29 and pin 32 is dropped into place to lock the sleeves against relative rotation with motor 12 out of the water as shown in phantom in FIG. 2. Since the motor is attached to the motor mount near its center of gravity, the motor can be rotated by hand without lifting the heavy motor. Moreover, the torque or twist to which a motor mount is subjected is reduced.

Figure 7:
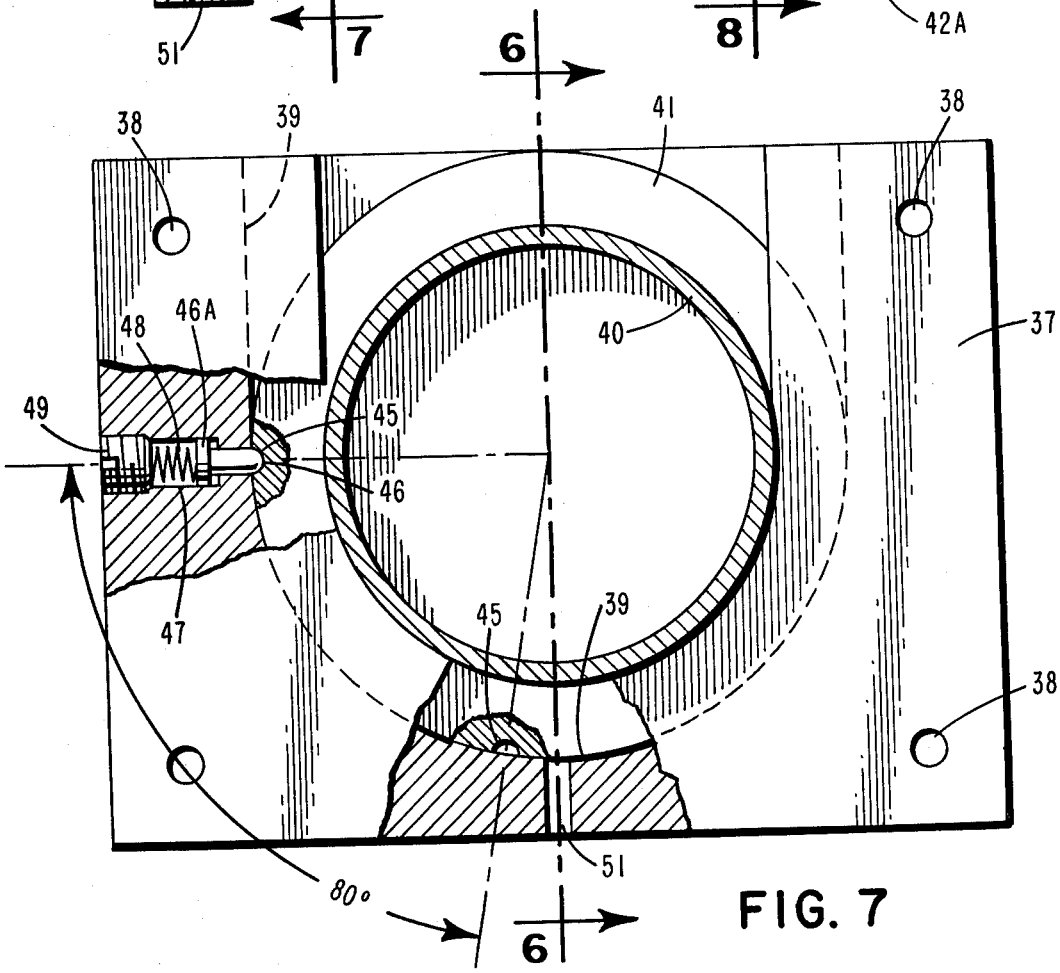
FIG. 7 is a cross-section taken along the line 7-7 of FIG. 6.
Figure 5:
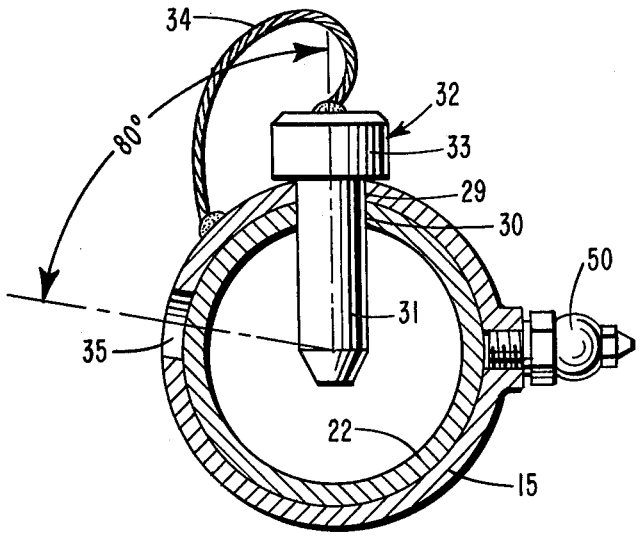
FIG. 5 is a cross-section taken along the line 5-5 of FIG. 3.
Figure 8:
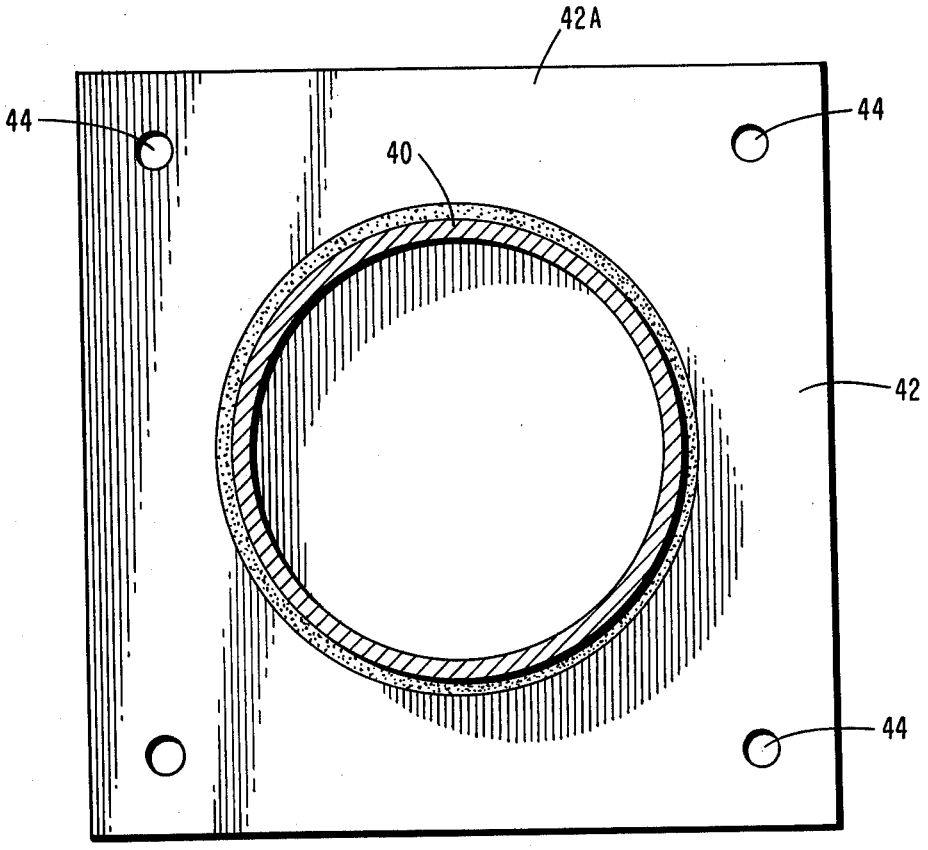
FIG. 8 is a cross-section taken along the line 8-8 of FIG. 6.

In the embodiment of the invention illustrated in FIGS. 6–8, a plate 37 is secured to a transom of a boat my means of bolts inserted through bolt holes 38. Plate 37 has a U-shaped opening which terminated on three sides in slot 39. Slot 39 is open at its top. A sleeve 40 has an integral flange 41 at one end and a plate 42 welded to the opposite end. The diameter of flange 41 is only slightly smaller than the transverse dimension between the facing walls of the slot 39 at its center line so that the flanged end 41 of sleeve 40 can be inserted from above in the U-shaped opening with flange 41 rotatably disposed in slot 39 as shown in FIG. 7. Plate 42 is larger in cross-section than sleeve 40 to provide an annular portion 42A. A series of circumferentially spaced holes 44 are provided in annular portion 42A for bolting sleeve 40 to a block similar to block 19 of FIG. 1. An outboard motor is secured to the block 19 by clamps in the same manner as described above and illustrated in FIG. 1.

As in the embodiment illustrated in FIGS. 1–5, the outboard motor of the embodiment of FIGS. 6–7 is attached to the mounting device with the center of gravity of the motor on or near the center line of rotation and the mounting device is attached to the transom of the boat so its center line of rotation is horizontal or near horizontal and at a point on the transom or well of a boat so the propeller is operably submerged in the water.

A pair of hemispherical sockets 45 are spaced about 80° apart in the peripheral edge of annular portion 42A as shown in FIG. 7. A detent pin 46 is slidably disposed from a stepped opening 47 in plate 37. Pin 46 has a head 46A and is biased toward socket 45 by spring 48 so its end will protrude into a socket 45 by when the socket is registered with the pin 46. Spring 48 is compressed between the pin 46 and a threaded plug 49. The notches 45 are located in flange 43 so that when pin 46 is locked in one of them, the outboard motor is in its upright operable position and when pin 46 is in the other notch 45, the motor is lifted out of the water in a position similar to that illustrated in FIG. 2. A drain hole 51 is provided at the bottom of slot 39 to drain splashed-in water.

The various parts of the mounting device may be made from any suitable metal such as steel or aluminum or from a suitable plastic. Block 19 may be metal or plastic instead of wood, if desired.

The novel motor mount has been illustrated and described as mounted on the transom of a boat for convenience but it can be mounted in the well of a boat on any other suitable support member on a boat.

Although the invention is described in detail for the purpose of illustration, it is to be understood that such detail is solely for that purpose and that variations can be made therein by those skilled in the art without departing from the spirit and scope of the invention except as it may be limited by the claims.

I claim:

1. A device for mounting an outboard motor to a transom of a boat, said motor having an inverted U-shaped clamp for securing it to a support member, said device comprising a sleeve, a plate secured to a first end of the sleeve and having a cross-section larger than that of the sleeve, a second plate attached to the first plate and adapted to be clamped to the motor by said clamp, an annular flange secured to the second end of the sleeve, a plate member having a U-shaped opening open at its top and having a closed bottom conforming to the configuration and dimensions of the lower half of the said annular flange, said plate member having an extension around its edge which forms a slot, said annular flange being rotatably disposed in the slot to secure the sleeve to the plate member, means for securing the plate member to a transom of a boat, and means for locking the flange against rotation in the slot when the motor is in an operable position and when the motor is rotated to a point out of the water.

2. A device of claim 1 wherein the means for locking the flange against rotation are circumferentially spaced detents.

3. A device for mounting an outboard motor on a boat, said device comprising two sleeves rotatably disposed one in the other, means attached to an exposed end of one of the sleeves for securing the sleeve to a support member of a boat against rotation and disposed in a plane perpendicular to the support member, means attached to an exposed end of the second sleeve for securing the second sleeve to the motor, means for locking the sleeves against relative rotation in a position where the motor is disposed out of the water, an inverted U-shaped clamp adapted to fasten the motor to a vertical support and wherein one of the sleeves is secured at one end to a first plate of larger cross-section than that of the sleeve, a support plate adapted to be clamped by said clamp is secured to the first plate, the first sleeve is disposed in the second sleeve with one end exposed, a plate member is secured to the exposed end of the first sleeve and comprises means for attaching the plate member to the support member of the boat, the outer sleeve has an arcuate slot extending not more than about 90° around the sleeve, a pin is secured to the inner sleeve and extends through said slot to secure the inner and outer sleeves against relative longitudinal movement and to limit the relative rotation of the sleeves, the outer sleeve has a hole therethrough and the inner sleeve has a first hole disposed to register with the hole in the outer sleeve when the motor has been rotated to a point where it is substantially out of the water, and a pin adapted to be inserted in said holes when they are registered to secure the sleeves against relative rotation.

* * * * *